US010029361B2

(12) United States Patent
Shen et al.

(10) Patent No.: US 10,029,361 B2
(45) Date of Patent: Jul. 24, 2018

(54) EMBEDDED DOORFRAME STRUCTURE OF TOOLBOX

(71) Applicant: JIANGSU TONGRUN EQUIPMENT TECHNOLOGY CO., LTD., Suzhou, Jiangsu (CN)

(72) Inventors: Jian Shen, Jiangsu (CN); Wenyu Chen, Jiangsu (CN)

(73) Assignee: Jiangsu Tongrun Equipment Technology Co., Ltd., Suzhou, Jiangsu (CN)

( * ) Notice: Subject to any disclaimer, the term of this patent is extended or adjusted under 35 U.S.C. 154(b) by 0 days.

(21) Appl. No.: 15/338,680

(22) Filed: Oct. 31, 2016

(65) Prior Publication Data

US 2018/0015610 A1 Jan. 18, 2018

(30) Foreign Application Priority Data

Jul. 14, 2016 (CN) ..... 2016 2 0740437 U

(51) Int. Cl.
*A47B 81/00* (2006.01)
*B25H 3/02* (2006.01)
*E06B 5/00* (2006.01)

(52) U.S. Cl.
CPC ..... *B25H 3/02* (2013.01); *A47B 81/00* (2013.01); *E06B 5/00* (2013.01)

(58) Field of Classification Search
CPC . Y10T 16/527; Y10T 16/5275; Y10T 16/528; A47B 81/00; B25H 3/02
USPC ..... 49/465, 463; 292/297; 312/326, 329, 312/324, 223.1, 257.1, 263, 265.1–265.6, 312/140; 16/229, 230, 231, 232, 235, 16/236, 237, 262, 386
See application file for complete search history.

(56) References Cited

U.S. PATENT DOCUMENTS 2,579,897 A * 12/1951 Blechman ..... A47B 43/02 217/65
2,722,468 A * 11/1955 Perrin ..... A47B 47/05 217/12 R
3,166,367 A * 1/1965 Vincens ..... E05D 7/1016 16/229
3,533,672 A * 10/1970 Gaston ..... A47B 47/00 312/263
4,190,929 A * 3/1980 Palka ..... E05D 7/1022 16/381

(Continued)

FOREIGN PATENT DOCUMENTS

JP 3119739 * 3/2006

*Primary Examiner* — Janet M Wilkens
(74) *Attorney, Agent, or Firm* — Juan Carlos A. Marquez; Marquez IP Law Office, PLLC

(57) ABSTRACT

Disclosed is an embedded doorframe structure of a toolbox. The left side and the right side of the doorframe structure is configured and fixed at the front end of a left lateral plate of the toolbox and a right lateral plate of the toolbox by a fastener. The upper side of the doorframe structure is connected to the inner side of the left lateral plate of the toolbox and the inner side of the right lateral plate of the toolbox by a screw. The lower side of the doorframe structure is configured at the front end of a bottom plate of the toolbox, and is clamped and fixed by the left lateral plate of the toolbox and the right lateral plate of the toolbox. A bolt of the toolbox is connected to the inner side of the doorframe structure.

6 Claims, 9 Drawing Sheets

(56) References Cited

U.S. PATENT DOCUMENTS

| | | | | | |
|---|---|---|---|---|---|
| 4,264,113 | A * | 4/1981 | Suttles | F16B 12/50 | 312/140.3 |
| 4,289,363 | A * | 9/1981 | Andersson | A47B 47/03 | 312/199 |
| 4,489,996 | A * | 12/1984 | Norton | A47F 9/00 | 312/140.4 |
| 4,836,626 | A * | 6/1989 | Taylor | A47B 47/03 | 312/257.1 |
| 5,570,940 | A * | 11/1996 | Maro | E06B 5/006 | 312/257.1 |
| 6,789,859 | B1 * | 9/2004 | Ho | A47B 47/02 | 312/257.1 |
| 7,866,770 | B2 * | 1/2011 | Wu | A47B 47/02 | 312/257.1 |
| 8,042,890 | B2 * | 10/2011 | Collins | A47B 47/0075 | 312/257.1 |
| 2008/0238277 | A1 * | 10/2008 | Geng | A47B 47/02 | 312/326 |
| 2013/0257248 | A1 * | 10/2013 | Bedkowski | H02B 1/38 | 312/329 |
| 2013/0342091 | A1 * | 12/2013 | Walker | H05K 5/0247 | 312/265.5 |
| 2016/0113126 | A1 * | 4/2016 | Guo | H05K 7/186 | 312/326 |

* cited by examiner

EMBEDDED DOORFRAME STRUCTURE OF TOOLBOX

BACKGROUND OF THE INVENTION

1. Technical Field

The instant disclosure relates to a toolbox; in particular, to an embedded doorframe structure of a toolbox.

2. Description of Related Art

An accommodation box, such as a toolbox, is usually consisted of a box structure and a door. However, if there is no doorframe, the toolbox cannot be firm enough to use, and is hard to stand still.

SUMMARY OF THE INVENTION

By providing an embedded doorframe structure of a toolbox, the structure of the toolbox can be enhanced and firm enough to use and can be easy to stand still.

The instant disclosure provides an embedded doorframe structure of a toolbox. A left side and A right side of the doorframe structure is configured and fixed at a front end of a left lateral plate of the toolbox and a right lateral plate of the toolbox by a fastener. An upper side of the doorframe structure is connected to an inner side of the left lateral plate of the toolbox and an inner side of the right lateral plate of the toolbox by a screw. A lower side of the doorframe structure is configured at a front end of a bottom plate of the toolbox, and is clamped and fixed by the left lateral plate of the toolbox and the right lateral plate of the toolbox. A bolt of the toolbox is connected to an inner side of the doorframe structure.

In one embodiment, the fastener is fixed at the inner side of the left lateral plate of the toolbox and the inner side of the right lateral plate of the toolbox.

In one embodiment, the embedded doorframe structure comprises a left-side frame, a right-side frame, an upper rail and a lower rail. The left-side frame and the right-side frame form a rectangle frame body. The upper rail and the lower rail are fixed at an upper side and a lower side of the rectangle frame body.

In one embodiment, a side cross section of the upper rail and the lower rail is U-shaped, and comprises a front portion, a back portion and an upper portion. The back portion of the side cross section of the upper rail and the lower rail has a screw hole.

In one embodiment, the upper rail has a baffle plate. The baffle plate is perpendicular with the front portion of the side cross section of the upper rail. Each ends of the baffle plate has a screw hole which is configured to fix with the left lateral plate of the toolbox and the right lateral plate of the toolbox by a screw.

In one embodiment, the doorframe structure is integrated.

In one embodiment, the bolt is configured at a top end and a bottom end of a door of the toolbox to connect to the upper side and the lower side of the doorframe structure.

In one embodiment, the toolbox comprises a back plate, lateral plates that are configured at a left side and a right side of the back plate, an upper plate and said bottom plate respective configured at an upper side and a lower side of the back plate, and a spacer configured on the back plate and between the upper plate and the bottom plate.

In one embodiment, the back plate is integrated or is formed by two plates, and a surface of the back plate has a positioning clamp.

To sum up, the advantages of this disclosure are as follows. The embedded doorframe structure of the toolbox is firm enough, and can be used in toolboxes having different structures to make the toolbox easy to stand still when people use it. The embedded doorframe structure of the toolbox in this disclosure has a simple and logical structure, costs less, and it is convenient for a user to assemble or maintain it. Thus, the embedded doorframe structure of the toolbox in this disclosure is promising in the market.

For further understanding of the instant disclosure, reference is made to the following detailed description illustrating the embodiments of the instant disclosure. The description is only for illustrating the instant disclosure, not for limiting the scope of the claim.

DETAILED DESCRIPTION OF THE EMBODIMENTS OF THE INVENTION

The aforementioned illustrations and following detailed descriptions are exemplary for the purpose of further explaining the scope of the instant disclosure. Other objectives and advantages related to the instant disclosure will be illustrated in the subsequent descriptions and appended drawings.

It will be understood that, although the terms first, second, third, and the like, may be used herein to describe various elements, but these elements should not be limited by these terms. These terms are only to distinguish one element from another region or section discussed below could be termed a second element without departing from the teachings of the instant disclosure. As used herein, the term "and/or" includes any and all combinations of one or more of the associated listed items.

Figure 1:
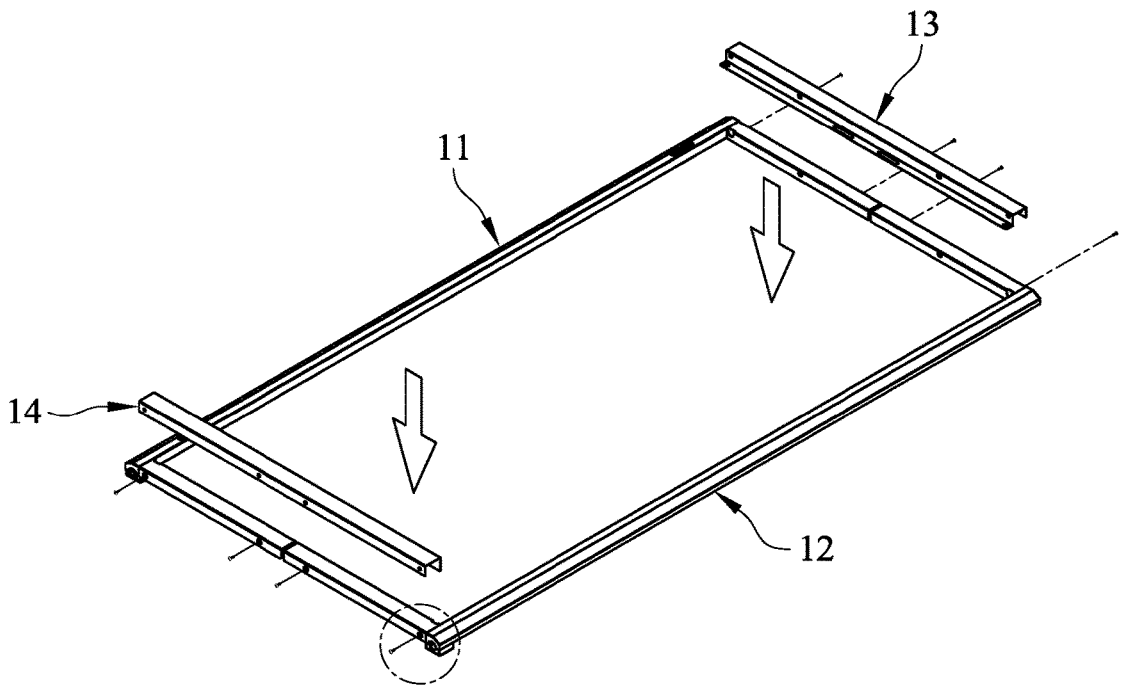
FIG. 1 is a schematic diagram showing an assembling process of an embedded doorframe structure of a toolbox in one embodiment of the instant disclosure.
Figure 2:
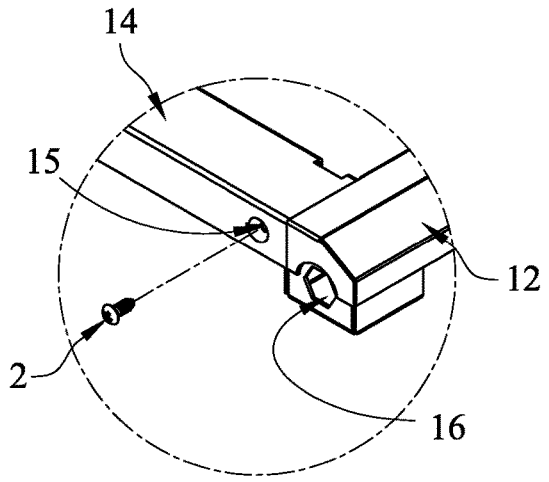
FIG. 2 is a locally enlarged drawing of FIG. 1.
Figure 3:
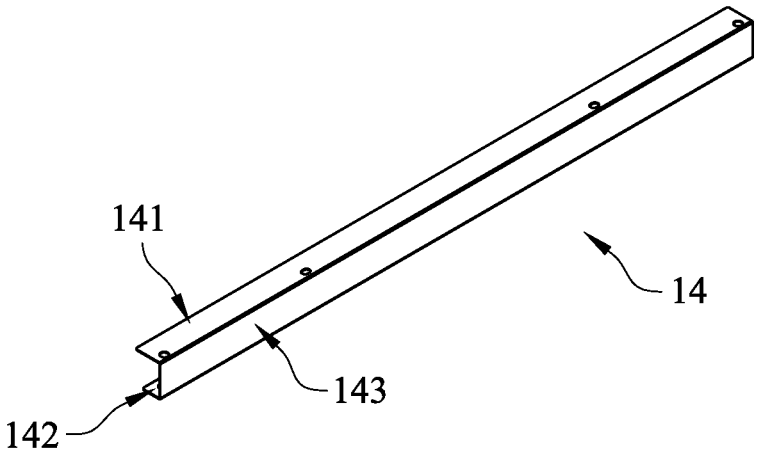
FIG. 3 shows a schematic diagram of a lower rail of one embodiment of the instant disclosure.
Figure 4:
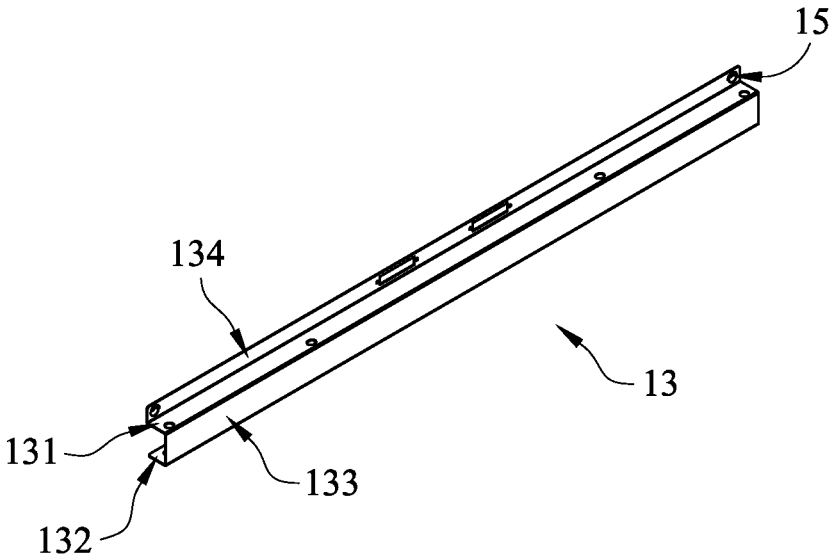
FIG. 4 shows a schematic diagram of an upper rail of one embodiment of the instant disclosure.
Figure 5:
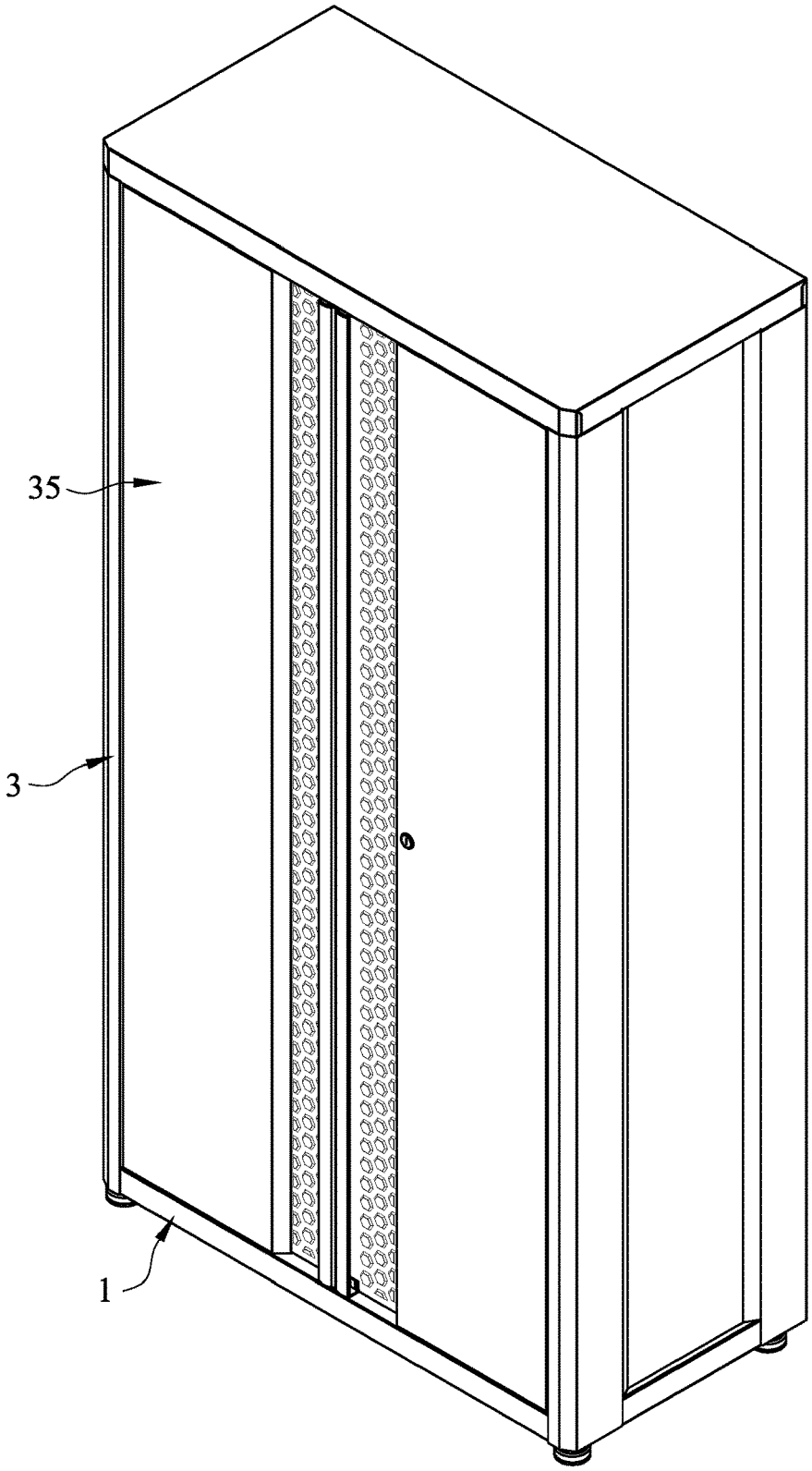
FIG. 5 is a schematic diagram showing a toolbox in one embodiment of the instant disclosure which is entirely closed.
Figure 6:
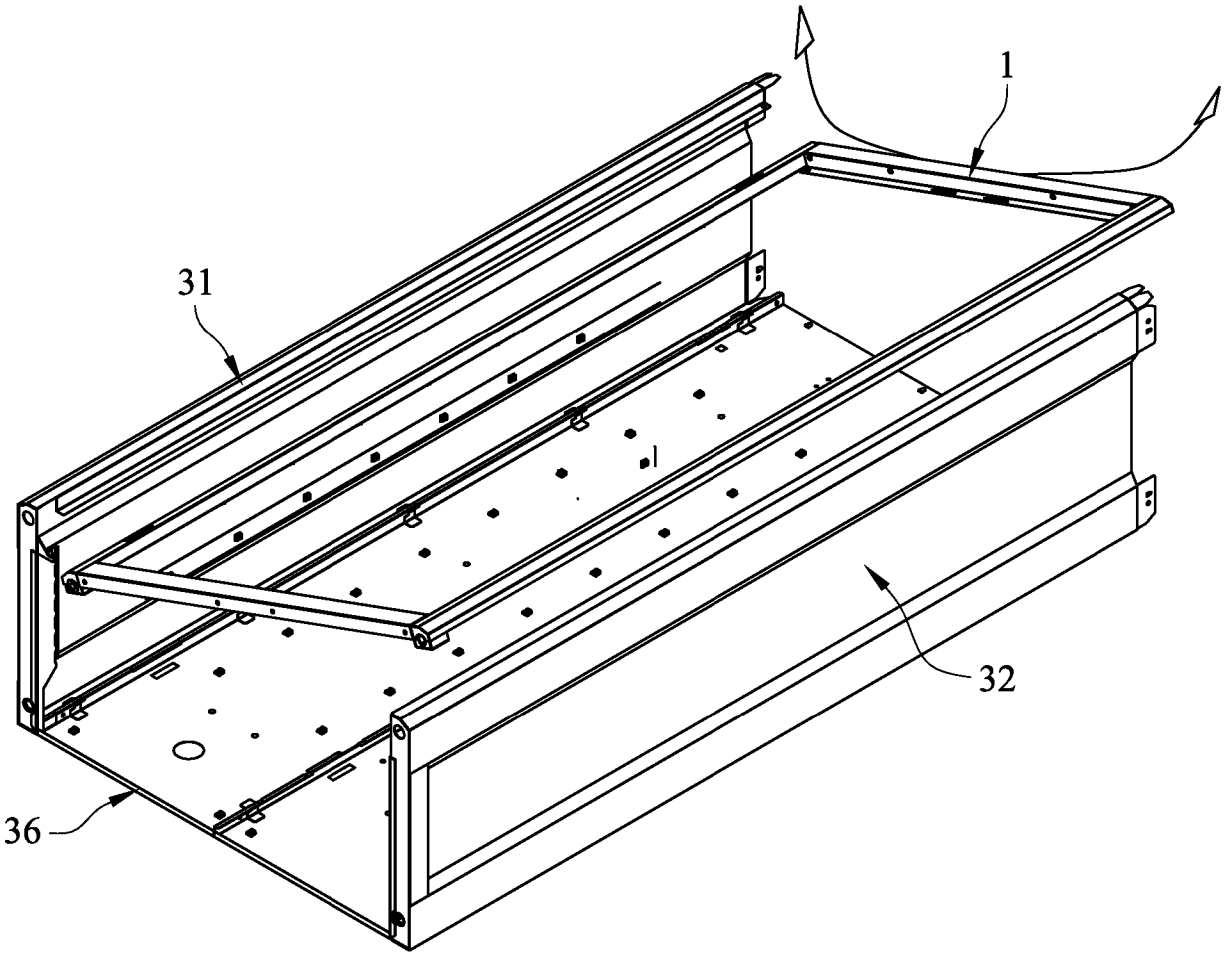
FIG. 6 is a schematic diagram showing how the doorframe structure is fastened by a fastener in one embodiment of the instant disclosure.
Figure 7:
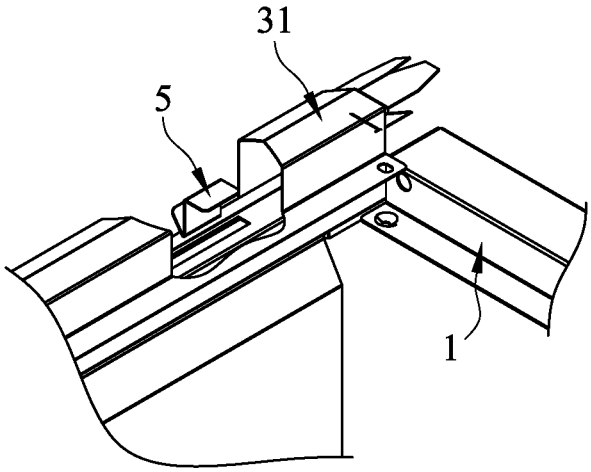
FIG. 7 is a schematic diagram showing that the fastener is fixed at the inner side of the lateral plate in one embodiment of the instant disclosure.
Figure 8:
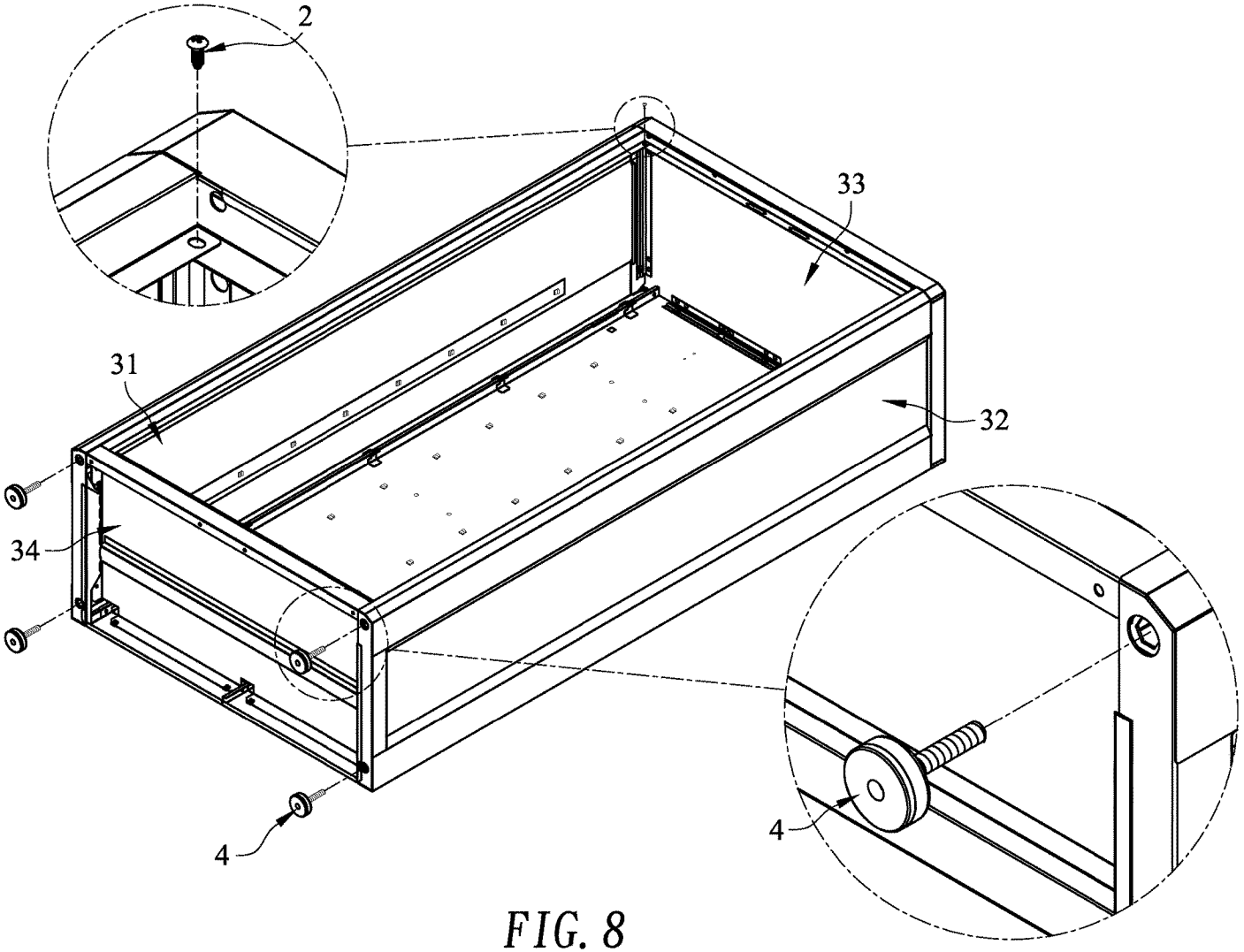
FIG. 8 is a schematic diagram showing the assembling structure between the doorframe structure and the toolbox in one embodiment of the instant disclosure.
Figure 9:
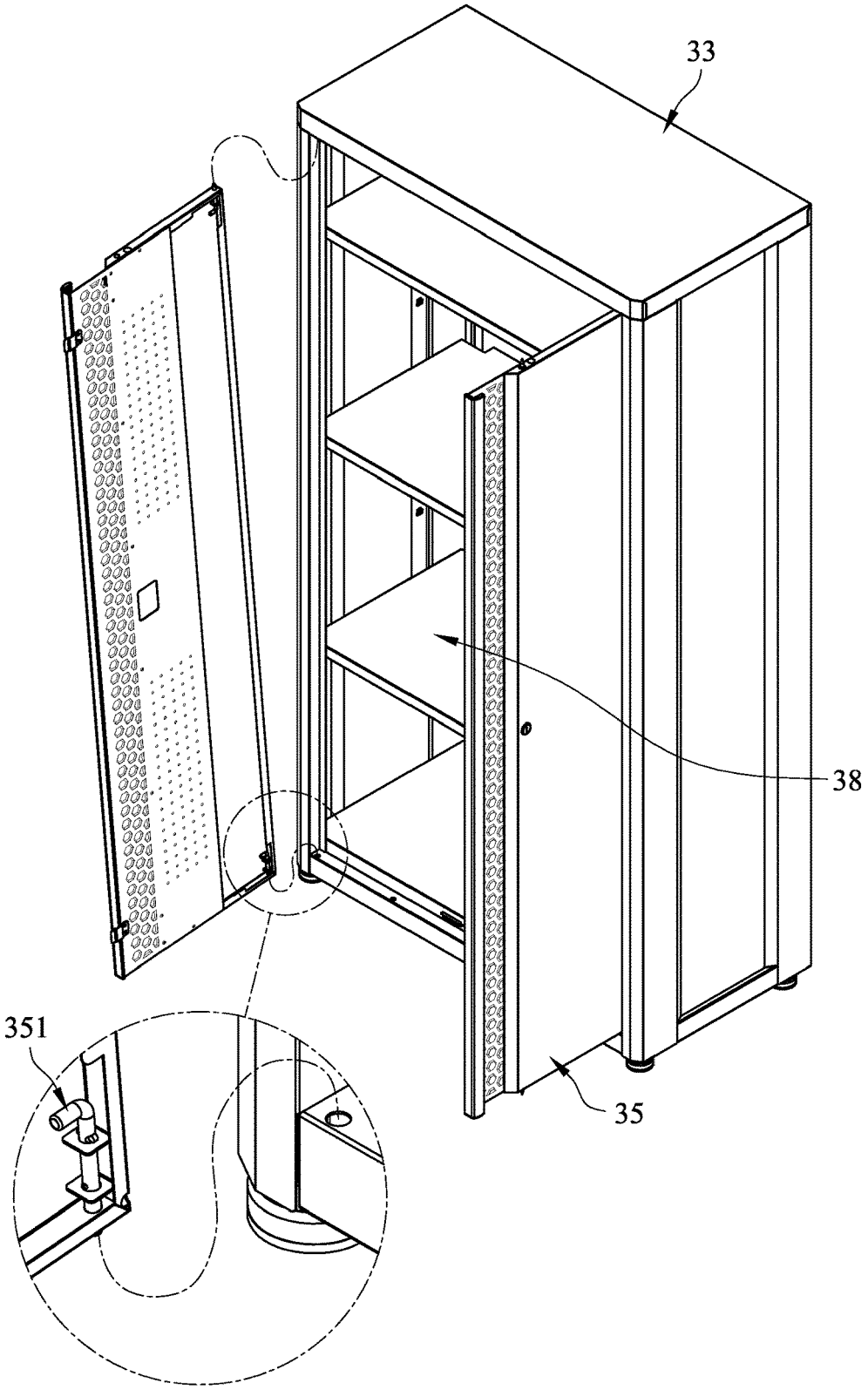
FIG. 9 is a schematic diagram showing the assembling structure between the door and the toolbox in one embodiment of the instant disclosure.
Figure 10:
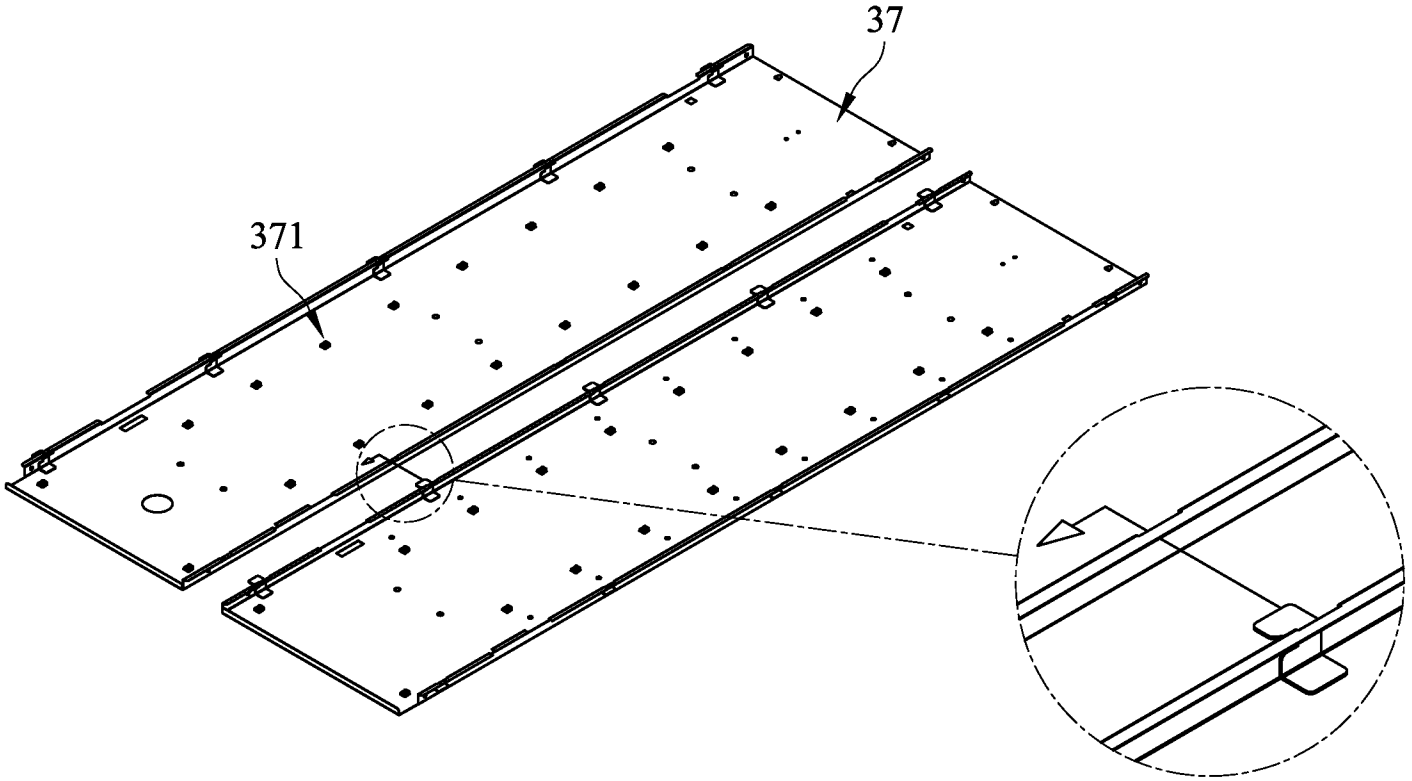
FIG. 10 is a schematic diagram showing the back plate in the first embodiment of the instant disclosure.
Figure 11:
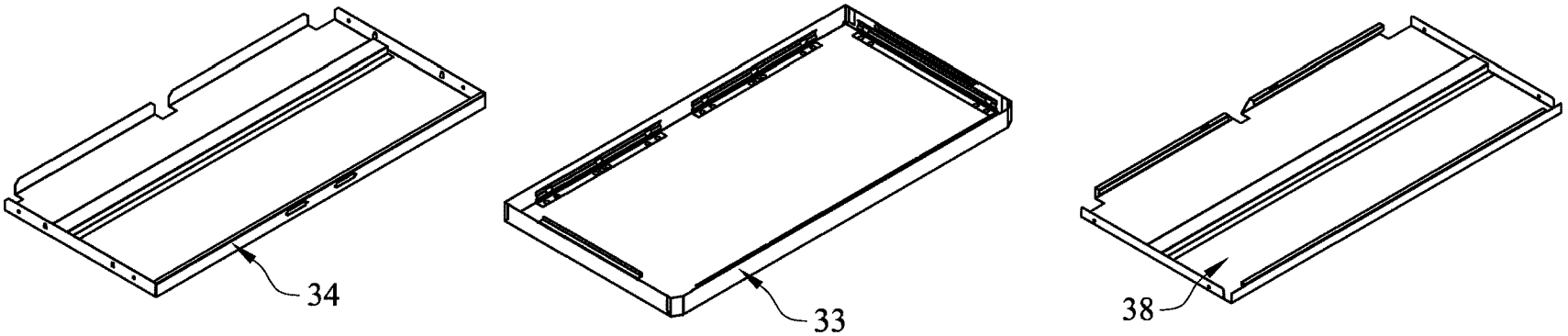
FIG. 11 is a schematic diagram showing the lateral plates and the spacer in one embodiment of the instant disclosure.

Referring to FIGS. 1-11, the instant disclosure provides embodiments as follows.

Embodiment 1

An embedded doorframe structure 1 of a toolbox comprises a left-side frame 11, a right-side frame 12, an upper rail 13 and a lower rail 14. The left-side frame 11 and the right-side frame 12 form a rectangle frame body. The upper rail 13 and the lower rail 14 are fastened at the upper side and the lower side of the rectangle frame body, and are fixed at the upper side and the lower side of the frame body by a plurality of screws to form a firm doorframe structure.

The side cross section of the upper rail 13 and the lower rail 14 is U-shaped, and comprises a front portion 131 and 141, a back portion 132 and 142, and a upper portion 133 and 143. The back portion 132 and 142 has screw holes 15 to make the upper rail 13 and the lower rail 14 are connected and fixed at the upper side and the lower side of the doorframe. A baffle plate 134 is configured on the upper rail 13, and the baffle plate 134 is perpendicular with the front portion 131. Each ends of the baffle plate 134 has screw holes 15 which are configured to fix with the left lateral plate of the toolbox and the right lateral plate of the toolbox by screws 2.

There is a horizontal adjusting spiral hole 16 at both sides of the bottom of the left-side frame 11 and the right-side frame 12. When the doorframe structure is installed to the toolbox, a horizontal adjusting spiral 4 is inserted to the horizontal adjusting spiral hole 16 to make sure the doorframe structure is well installed and horizontal.

How the doorframe structure 1 is embedded in the toolbox 3 is described as follows. The left side and the right side of the doorframe structure 1 are fastened by the fastener 5 at the front end of the left lateral plate and the right lateral plate of the toolbox 3. Specifically, the baffle plate 134 on the upper rail 13 helps the doorframe structure 1 to be fixed at the front end of the left lateral plate and the right lateral plate of the toolbox 3 with screws 2. The U-shaped lower rail of the doorframe structure 1 is fastened to the front end of the bottom plate 34 of the toolbox 3. In addition, two ends of the lower rail are clamped by the left lateral plate 31 and the right lateral plate 32.

The door 35 of the toolbox 3 is configured at the inner side of the doorframe structure 1 and is connected to the bolt of the doorframe structure 1.

There are four fasteners 5, and they are respectively configured at two ends of the inner side of the left lateral plate 31 and the right lateral plate 32 to fix the doorframe structure 1. Thus, there is no need to have one person to hold the doorframe structure 1 when installing.

The door 35 of the toolbox 3 is within the doorframe structure 1. There is a bolt 351 configured at both of the top end and the bottom end of the door 35 of the toolbox 3. There is a bolt hole correspondingly configured at the inner side of both of the upper rail 13 and the lower rail 14 of the doorframe structure 1. The bolts 351 of the door 35 are inserted into the bolt hole at the upper rail 13 and the lower rail 14 of the doorframe structure 1 to connect the door 35 and the doorframe structure 1. The door 35 can be opened and closed by using a magnetic connecting member.

The toolbox 3 comprises a back plate 36, a left lateral plate 31, a right lateral plate 32, an upper plate 33, a bottom plate 34 and a plurality of spacers 37. The back plate 35 comprises two plates 37 connected with each other by using positioning clamps 371. The left lateral plate 31 and the right lateral plate 32 are connected and fixed at the left side and the right side of the back plate 36. The upper plate 33 and the bottom plate 34 are connected and fixed at the upper side and the lower side of the back plate 36 by using positioning clamps. The spacers 37 are fixed on the back plate 36, and separated with each other by a distance. Specifically speaking, the spacers 37 are configure between the upper plate 33 and the bottom plate 34.

The lower side of the bottom plate 34 is fastened on the back plate 36. The left side and the right side of the bottom plate 34 are respectively fastened at the left lateral plate 31 and the right lateral plate 32. The front end of the bottom plate 34 is connected to the inner side of the doorframe structure 1, and helps to clamp and fix the doorframe structure 1 together with the left lateral plate 31 and the right lateral plate 32. Thus, there is no need to use screws to fix the doorframe 1 and the bottom plate 34. The spacer 38 is parallel with the bottom plate 34, and is fastened on the back plate 36. The left side and the right side of the spacer 38 are respectively fastened on the left lateral plate 31 and the right lateral plate 32.

Embodiment 2

Different from the embodiment 1, in this embodiment, the doorframe structure 1 is integrated. In other words, the doorframe structure 1 needs not to be taken apart as the left-side frame 11, the right-side frame 12, the upper rail 13 and the lower rail 14, and then be assembled together.

Embodiment 3

Different from the embodiment 1, in this embodiment, the back plate 36 is an integrated plate, the assembling of the back plate 36 is not needed.

The features of the present invention are disclosed above by the preferred embodiment to allow persons skilled in the art to gain insight into the contents of the present invention and implement the present invention accordingly. The preferred embodiment of the present invention should not be interpreted as restrictive of the scope of the present invention. Hence, all equivalent modifications or amendments made to the aforesaid embodiment should fall within the scope of the appended claims.

What is claimed is:

1. An embedded doorframe structure of a toolbox, wherein a left side and a right side of the doorframe structure are each configured and fixed at a front end of a left lateral plate of the toolbox and a front end of a right lateral plate of the toolbox, respectively, by a fastener;

an upper side of the doorframe structure is connected to an inner side of the left lateral plate of the toolbox and an inner side of the right lateral plate of the toolbox by a screw;

a lower side of the doorframe structure is configured at a front end of a bottom plate of the toolbox, and is clamped and fixed by the left lateral plate of the toolbox and the right lateral plate of the toolbox; and a bolt of the toolbox is connected to an inner side of the doorframe structure;

wherein the toolbox comprises a back plate, said left and right lateral plates being configured at a left side and a right side of the back plate, respectively, an upper plate and said bottom plate configured at an upper side and a lower side of the back plate, respectively, and a spacer configured on the back plate and between the upper plate and the bottom plate, and wherein the back plate is integrated or formed by two plates, and a surface of the back plate has a positioning clamp.

2. The embedded doorframe structure according to claim 1, wherein the fastener is fixed at the inner side of the left lateral plate of the toolbox and the inner side of the right lateral plate of the toolbox.

3. The embedded doorframe structure according to claim 1, wherein the doorframe structure is integrated.

4. The embedded doorframe structure according to claim 1, wherein the bolt is configured at a top end and a bottom end of a door of the toolbox to connect to the upper side and the lower side of the doorframe structure.

5. An embedded doorframe structure of a toolbox, comprising a left-side frame, a right-side frame, an upper rail, and a lower rail, wherein the left-side frame and the right-side frame form a rectangle frame body, and the upper rail and the lower rail are fixed at an upper side and a lower side of the rectangle frame body, wherein a left side and a right side of the doorframe structure are each configured and fixed at a front end of a left lateral plate of the toolbox and a front end of a right lateral plate of the toolbox, respectively, by a fastener;

an upper side of the doorframe structure is connected to an inner side of the left lateral plate of the toolbox and an inner side of the right lateral plate of the toolbox by a screw;

a lower side of the doorframe structure is configured at a front end of a bottom plate of the toolbox, and is clamped and fixed by the left lateral plate of the toolbox and the right lateral plate of the toolbox;

a bolt of the toolbox is connected to an inner side of the doorframe structure;

wherein a back plate is integrated or is formed by two plates, and a surface of the back plate has a positioning clamp, and wherein a side cross section of the upper rail and the lower rail is U-shaped, and comprises a front portion, a back portion and an upper portion, and the back portion of the side cross section of the upper rail and the lower rail has a screw hole.

6. The embedded doorframe structure according to claim 5, wherein the upper rail has a baffle plate, the baffle plate is perpendicular with the front portion of the side cross section of the upper rail, and each end of the baffle plate has a screw hole which is configured to fix with the left lateral plate of the toolbox and the right lateral plate of the toolbox by a screw.

* * * * *